US006282732B1

(12) United States Patent
Krvavica et al.

(10) Patent No.: US 6,282,732 B1
(45) Date of Patent: Sep. 4, 2001

(54) TOILET FLUSHING HANDLE ACCESSORY

(76) Inventors: Patricia A. Krvavica; Michaelle A. Krvavica; Mark-Robert Bluemel, all of 3232 Fourth Ave., San Diego, CA (US) 92103

( * ) Notice: Subject to any disclaimer, the term of this patent is extended or adjusted under 35 U.S.C. 154(b) by 0 days.

(21) Appl. No.: 09/604,545

(22) Filed: Jun. 26, 2000

Related U.S. Application Data

(63) Continuation-in-part of application No. 09/282,801, filed on Mar. 31, 1999, now abandoned.

(51) Int. Cl.[7] ..... E03D 5/00
(52) U.S. Cl. ..... 4/405; 4/228.1; 4/246.1
(58) Field of Search ..... 4/405, 228.1, 246.1, 4/222

(56) References Cited

U.S. PATENT DOCUMENTS

| | | | | |
|---|---|---|---|---|
| 3,143,745 | * | 8/1964 | Price | 4/222 |
| 4,353,139 | | 10/1982 | Wainwright et al. | 4/661 |
| 4,434,938 | | 3/1984 | Rosenkrantz et al. | 239/274 |
| 4,521,919 | | 6/1985 | Molloy | 455/344 |
| 4,856,140 | | 8/1989 | Visco et al. | 16/114 R |
| 4,979,238 | | 12/1990 | Clark | 4/251 |
| 5,499,008 | * | 3/1996 | Rosenkrantz et al. | 340/384.7 |
| 5,675,845 | * | 10/1997 | Martin et al. | 4/228.1 |
| 5,727,258 | * | 3/1998 | Derouin | 4/246.1 |
| 5,873,766 | * | 2/1999 | Burton | 446/421 |

* cited by examiner

*Primary Examiner*—Charles E. Phillips
(74) *Attorney, Agent, or Firm*—Gary L. Eastman

(57) ABSTRACT

The toilet flushing handle accessory of the present invention includes a decorative figure attached to an existing toilet flushing handle to customize and decorate a toilet. The toilet flushing handle accessory can include an electronic sound module to provide for recording and playback of audio messages, and a pressurized scented spray canister for providing a scented spray upon each activation of the toilet flushing handle.

1 Claim, 6 Drawing Sheets

TOILET FLUSHING HANDLE ACCESSORY

RELATED APPLICATIONS

This patent application is a Continuation-In-Part of U.S. patent application Ser. No. 09/282,801, filed Mar. 31, 1999, abandoned.

FIELD OF THE INVENTION

The present invention relates generally to home furnishings. More particularly, though not exclusively, the present invention relates to an accessory for decorating, customizing, or otherwise personalizing an existing toilet flushing handle.

BACKGROUND OF THE INVENTION

One of the first activities undertaken when setting up a home is the personalization of the home by selecting various home furnishings. These home furnishings provide the resident an opportunity to express their artistic and stylistic preferences through artwork, color combinations, and furniture. Consistent with this trend, many people continue their artistic expressions into their bathrooms. For example, some people like to decorate their bathrooms with a theme such as clowns, cows or other farm animals, balloons, or other objects or subjects.

Unfortunately, there are few accessories available to change the appearance of a toilet. Currently available accessories include placing a sock-type decorative cover over a spare toilet paper roll on the lid of the toilet tank to disguise the spare roll. Even more common is the bath floor-matte, which is often shaped to contour the base of the toilet, and may provide cushion the feet of the toilet user. There is also the option of putting a cover on the toilet seat lid or a cover over the toilet tank itself. None of these presently available accessories provide for the customization of the flushing handle.

SUMMARY OF THE INVENTION

In light of the above, a toilet flushing handle accessory is provided which gives the user a novel and extremely functional way of customizing an existing toilet flush activator arm, also called a toilet flushing handle. The toilet flushing handle accessory of the present invention relates generally to an apparatus and method for decorating and personalizing the existing toilet flushing handle on a toilet.

The toilet flushing handle accessory of the present invention enables an individual to make a visual and audible statement. The toilet flushing handle accessory of the present invention may be equipped with a variety of attachment mechanisms to securely fasten the toilet flushing handle accessory to virtually any shape and size toilet flushing handle. In this manner, an otherwise sterile or un-decorative toilet tank may be decorated and personalized.

The toilet flushing handle accessory of the present invention allows the individual to add an extra touch to their bathroom decor. Instead of having to depress a standard toilet flushing handle, the individual will be able to attach the present invention, and depress it to flush the toilet. One advantage of this invention is that since it can be easily attached and also removed, the individual can change the toilet flushing handle accessory to suit their desire to make a statement or reflect for instance a change in the season or National holiday. Further, the toilet flushing handle accessory of the present invention enables an individual to make a visual and audible statement to every member of the household, or other persons using the toilet.

Using the toilet is common to most every human being. Thus, with the toilet flushing handle accessory of the present invention, a message may be conveyed to everyone in the household. For instance, a toilet flushing handle accessory of the present invention which announces "Happy Birthday" could be attached to an otherwise ordinary toilet flushing handle to surprise a loved one on their Birthday. Also, the toilet flushing handle accessory of the present invention can be used to relay more serious messages, such as "Stop Using Crack", "Thank You For Flushing", or "Don't Forget To Wash Your Hands".

The toilet flushing handle accessory of the present invention could also be used to honor the individual's ethnicity or National origin. For example, the Stars and Stripes, or the Croatian Flag, could be embodied in the toilet flushing handle accessory. Naturally, the toilet flushing handle accessory of the present invention could be used to represent flags or symbols for any ethnicity or group.

Toilet training a toddler can be a difficult time, for both the child and parents or care givers. The toilet flushing handle accessory of the present invention could be used to help a young person learn to use the toilet by rewarding them with the opportunity to use the toilet flushing handle accessory of the present invention and flush, after successfully using the toilet. To further incentivize the young person, a sound-generator could be added to the present invention, such as an electronic circuit which would emit a sound, such as an emphatic "Hoorah!"

The toilet flushing handle accessory of the present invention could also be outfitted with a recording device enabling the individual user to make their own message, cheer or other sound. Once the recording device has been used to record a message, the toilet flushing handle accessory may repeat the recorded message upon each activation of the toilet flushing handle with the invention attached. This could also make the invention more useful as an incentive during the toilet training of a toddler.

Because odor is a concern in virtually every bathroom, the toilet flushing handle accessory of the present invention may be equipped with scented portion, such as "potpourri" or other means of gradually and steadily releasing a pleasant scent. Alternatively, the toilet flushing handle accessory of the present invention could include a spray canister containing scented spray which would emit a spray burst upon the depression of the toilet flushing handle. The scented spray would conveniently and effectively mask any odors left by the toilet user.

Therefore, an object of the present invention is to provide a means of decorating an existing toilet flushing handle with an easily attachable and removable device. A further object of the present invention is to provide an attachable and removable device for the decoration and customization of an existing toilet. Yet another object of the present invention is to provide a toilet flushing handle accessory having virtually any shape or figure thereby providing unlimited opportunity for the decoration and customization of a toilet.

The toilet flushing handle accessory of the present invention includes the main body of the invention equipped with one or more fasteners. The body is made out of a material suitable for exposure to manipulation and moisture, such as plastic and ceramics. Each fastener may be fixed to the body and attachable to an existing toilet flushing handle. The toilet flushing handle accessory of the present invention may also be equipped with a audio recording and playback circuit for recording and playing back a message or announcement, and may also be equipped with a scent producing module, including a scented spray canister and dispensing mechanism for dispensing a burst of pleasantly scented spray.

BRIEF DESCRIPTION OF THE DRAWINGS

The above mentioned and other objects and features of this invention and the manner of attaining them will become apparent, and the invention itself will be best understood by reference to the following description of the embodiment, of the invention in conjunction with the accompanying drawings, wherein.

DETAILED DESCRIPTION OF THE INVENTION

Figure 1:
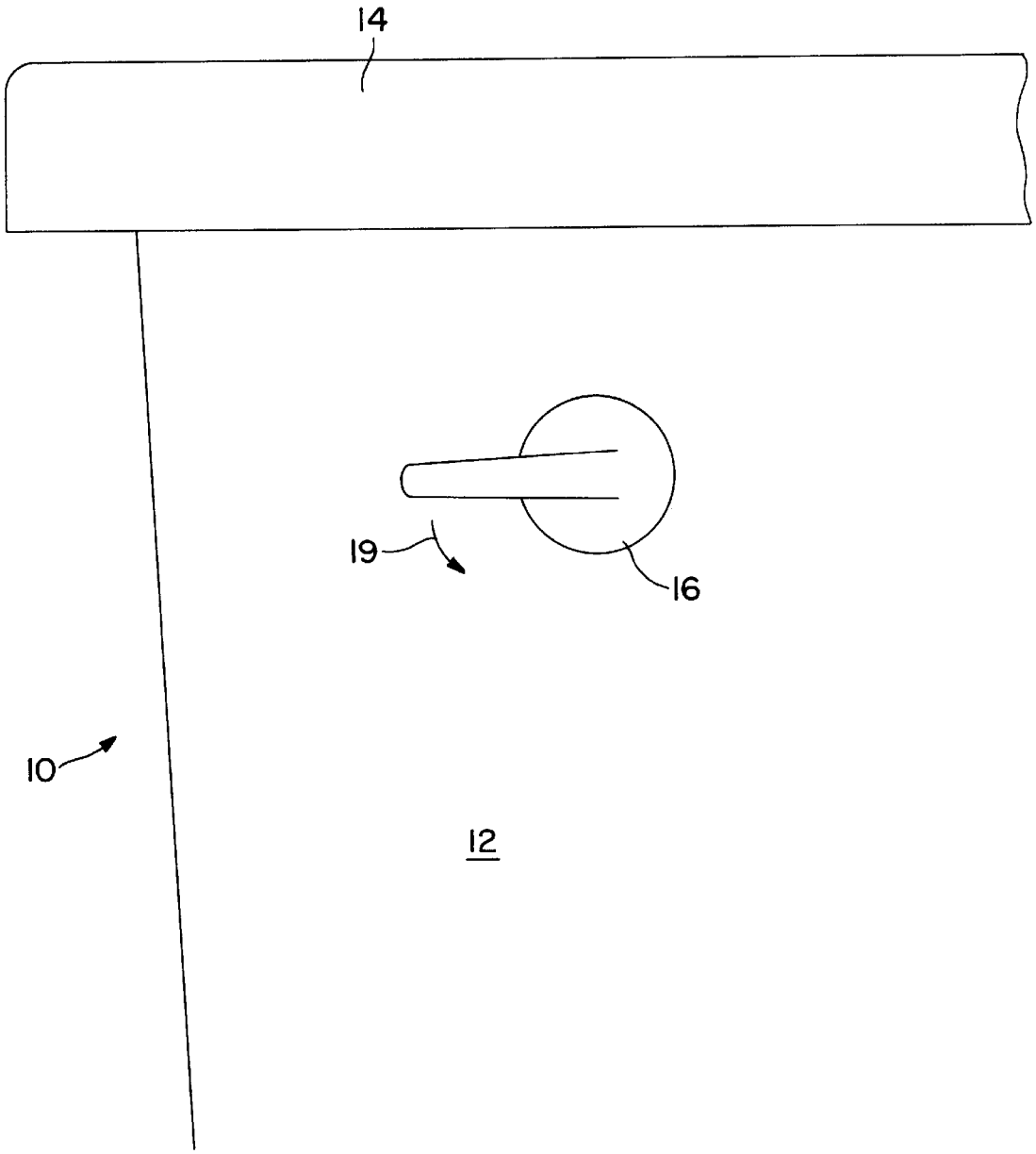
FIG. 1 is a perspective view of the standard toilet tank assembly, standing alone and showing the toilet flushing handle, the water tank, and the toilet tank lid.

Referring initially to FIG. 1, the relevant portion of a standard toilet is shown and generally designated 10. Toilet 10 includes a tank 12, a tank lid 14 and a handle 16 which may be rotated in direction 19 to flush the toilet. Although toilet 10 and flushing handle 16 are shown to have a particular shape, such shapes are merely exemplary and it is to be understood that the present invention may be used in conjunction with any toilet with a rotating flushing handle, regardless of its particular shape.

Figure 2:
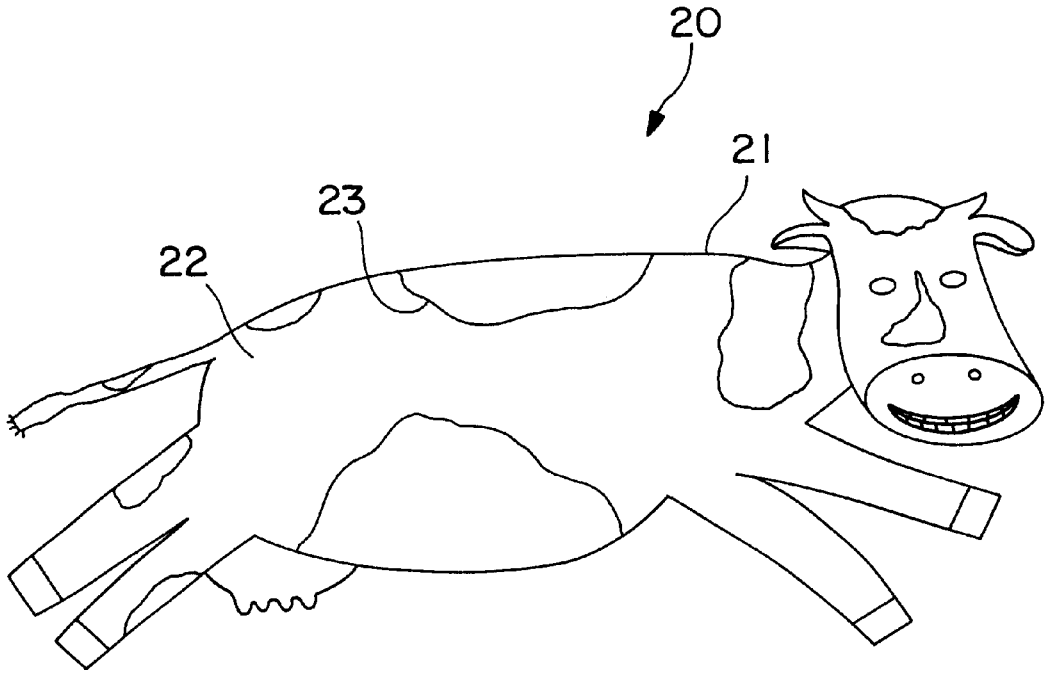
FIG. 2 is a front view of the toilet flushing handle accessory of the present invention standing alone, and shaped to depict the likeness of a cow.
Figure 3:
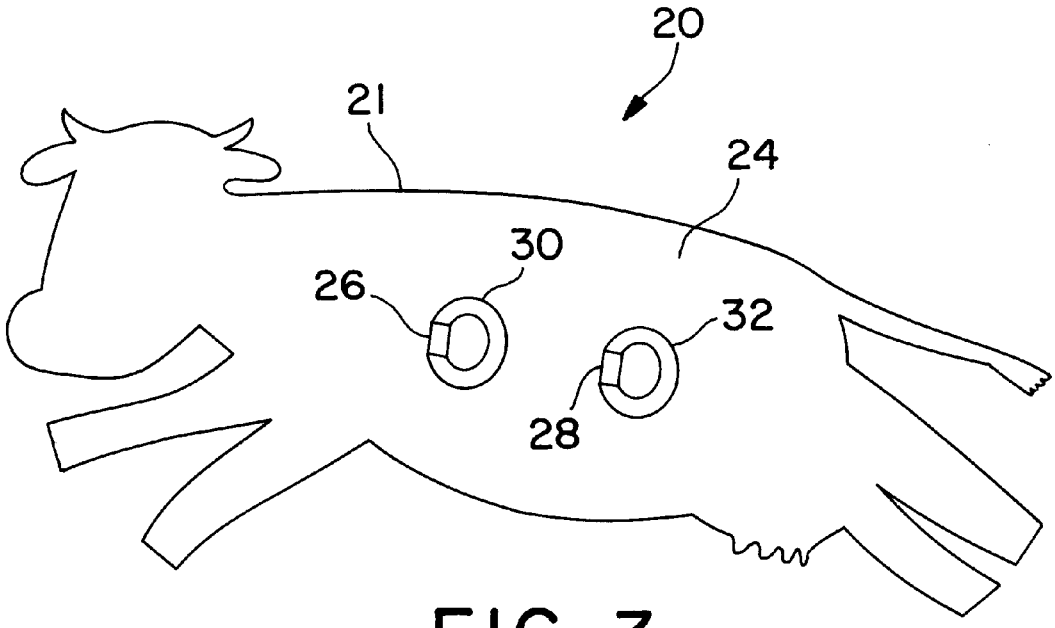
FIG. 3 is a view of the back-side, or non-viewable side, of the body of the toilet flushing handle accessory of the present invention showing the O-ring fasteners which attach the invention to the toilet flushing handle and the ring clips from which the rubber O-ring fasteners connect to the body.

Referring now to FIGS. 2 and 3, the toilet flushing handle accessory of the present invention is shown and generally designated 20. Toilet flushing handle accessory 20 includes a body 21 having a front side 22 and a back-side 24 and is shaped to depict a cow. Additionally, front side 22 may be painted with pattern 23 to more closely resemble a cow. While the toilet flushing handle accessory 20 of the present invention is shaped to depict a cow, it is merely exemplary, and it should be understood that the form of the body may be that of anything from farm animals to patriotic symbols or banners.

Figure 5:
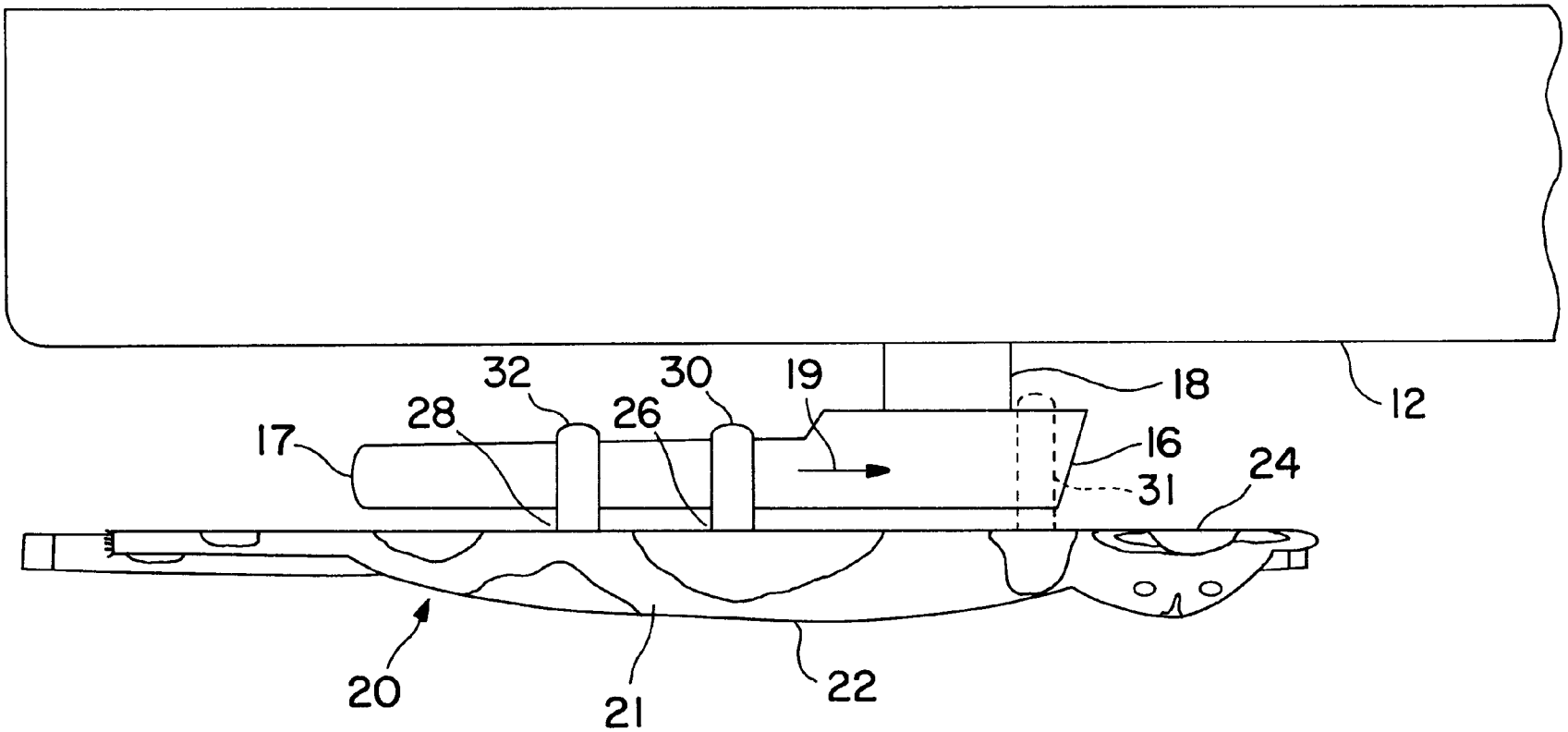
FIG. 5 is a top view of the invention as attached to the toilet flushing handle of a standard toilet, showing the point of attachment to the toilet flushing handle with the rubber O-ring fasteners.

Referring specifically to FIG. 3, the back side 24 of toilet flushing handle accessory 20 is equipped with a pair of ring clips 26 and 28. Ring clips 26 and 28 accept fasteners 30 and 32, respectively. Fasteners 30 and 32, in a preferred embodiment, are made from rubber and, as will be discussed further in conjunction with FIG. 5, are expandable to receive a portion of toilet flushing handle 16 shown in FIG. 1. These fasteners 30 and 32, however, may be made from any material having an elastic characteristic that will provide for the expansion of the fastener to receive the toilet flushing handle 16 and secure the toilet flushing handle accessory 20 in place.

Figure 4:
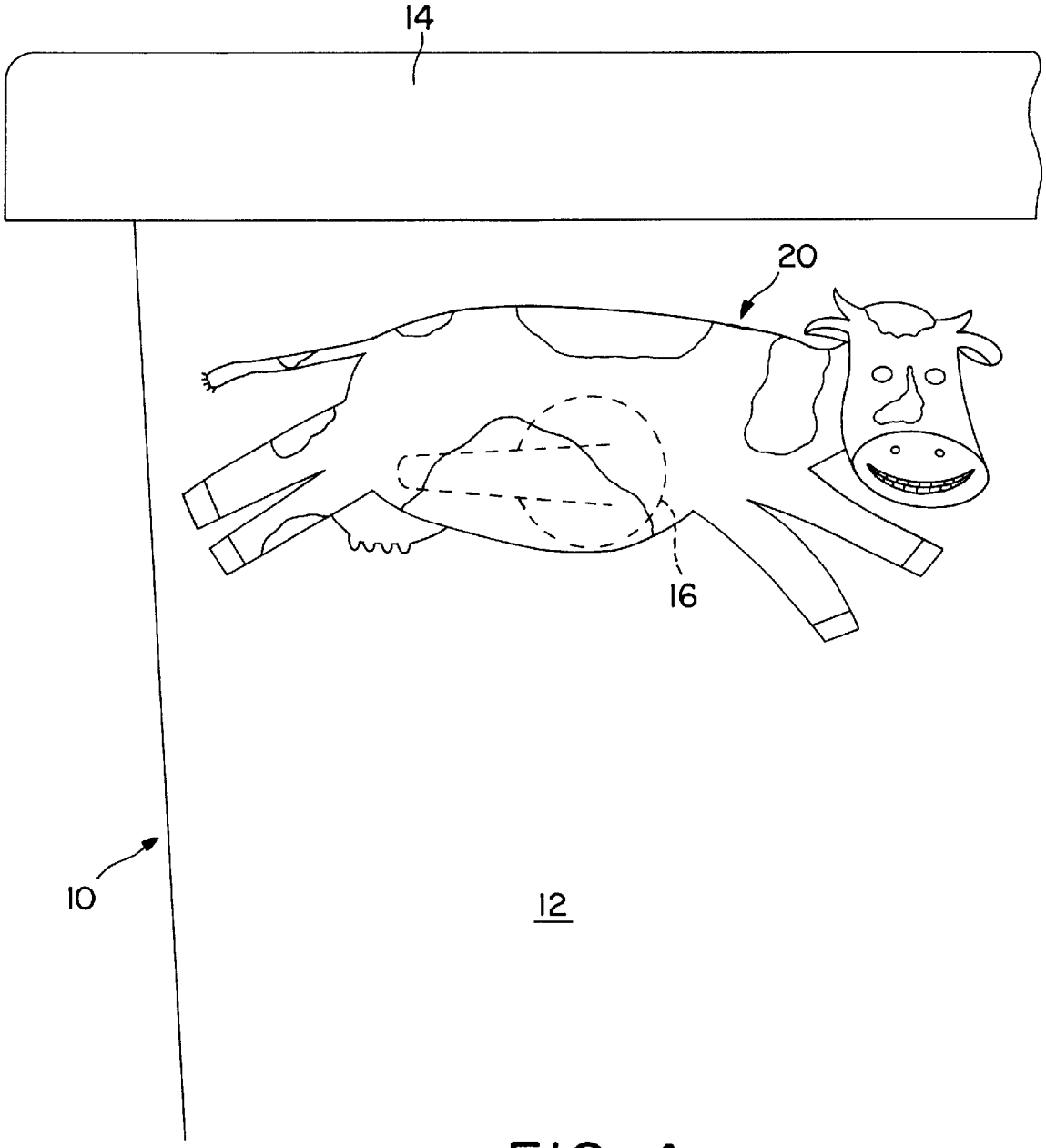
FIG. 4 is a front view of the toilet flushing handle accessory of the present invention as attached to the toilet flushing handle of a standard toilet.

Referring now to FIG. 4, toilet flushing handle accessory 20 is shown as installed on toilet 10. From FIG. 5, the positioning of fasteners 30 and 32 are shown. More specifically, to install the toilet flushing handle accessory 20 on the toilet handle 16, fasteners 30 and 32 are positioned adjacent end 17 and toilet flushing handle accessory 20 is urged in direction 19 toward handle shaft 18. Once fully advanced onto handle 16, the elastic characteristics of fasteners 30 and 32 retain the toilet flushing handle accessory 20 in place. An additional fastener 31 (shown in dashed lines) may be incorporated into toilet flushing handle accessory 20 to further secure it in place on handle 16.

Alternative Embodiments

Figure 6:
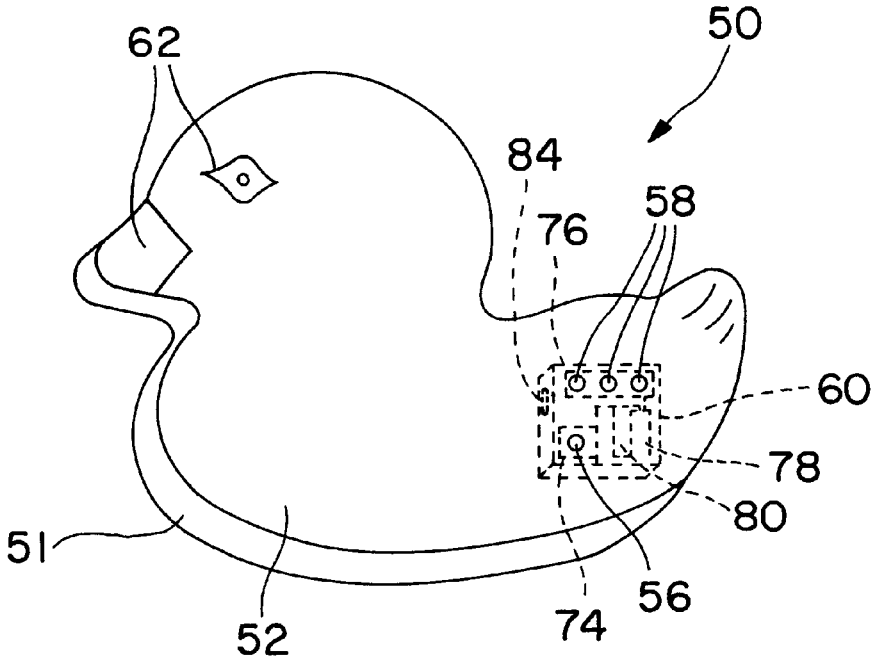
FIG. 6 is a perspective view of an alternative embodiment of the toilet flushing handle accessory of the present invention showing a body shaped to depict a duck, and formed with a single microphone aperture and one or more audio output, or speaker, apertures.
Figure 7:
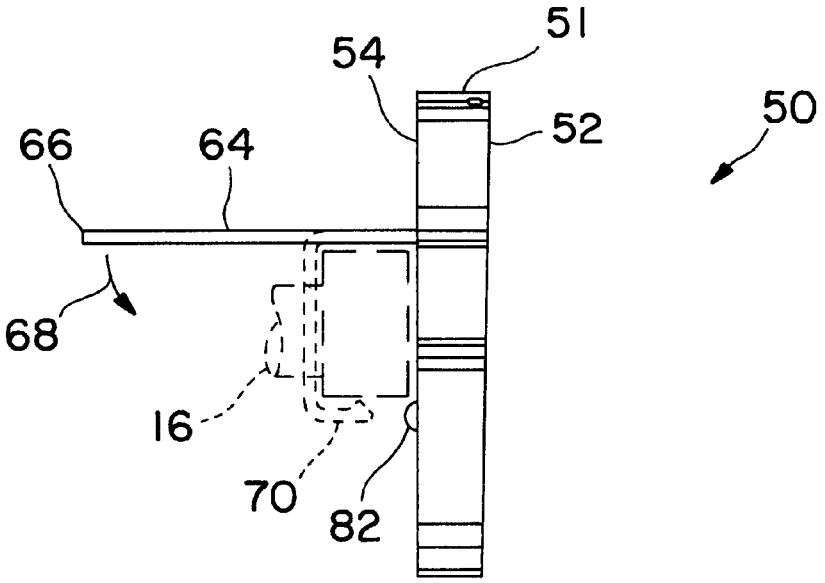
FIG. 7 is a side view of the alternative embodiment of the toilet flushing handle accessory of the present invention of FIG. 6, showing the attachment to the toilet flushing handle using a semi-rigid attachment strap, or flexible metal strip.

Referring now to FIGS. 6 and 7, an alternative embodiment of the toilet flushing handle accessory of the present invention is shown and generally designated 50. Toilet flushing handle accessory 50 includes a body 51 having a front surface 52 and a rear surface 54. Front surface 52 may be formed with a microphone aperture 56, and speaker apertures 58 so that electronic sound module 60 can receive an audio input for recording through microphone aperture 56, and produce an audio output through speaker apertures 58.

Front surface 52 of body 51 of toilet flushing handle accessory 50 may be decorated to resemble an animal. For instance, body 51 of toilet flushing handle accessory 50 resembles a duck, and accordingly, could be painted or decorated with markings 62 to further complete the resemblance. In addition to markings 62, the toilet flushing handle accessory 50 may be contoured to further resemble a duck in the same manner of toilet flushing handle accessory 20, discussed above.

From FIG. 7, a side view of toilet flushing handle accessory 50 is shown. From this view the semi-rigid attachment strap 64 is shown to extend perpendicularly from the back surface 54 of body 51. In a preferred embodiment, semi-rigid attachment strap 64 is formed of a metallic material which exhibits a high degree of malleability, thereby enabling the end 66 of semi-rigid attachment strap 64 to be positioned against a flushing handle 16 and bent in direction 68 to a final position 70 (shown in dashed lines). The semi-rigid nature of attachment strap 64 retains the toilet flushing handle accessory 60 securely in place on flushing handle 16, yet provides for the easy removal of the toilet flushing handle accessory 60 by simply unbending the attachment strap 64.

Electronic sound module 60, in a preferred embodiment, includes a microphone element 74, such as an electret microphone as is well known in the art, a speaker element 75, such as a piezo transducer as is well known in the art. In electrical connection to both microphone element 74 and speaker element 76 is a digital controller or microcontroller 78 which receives analog audio signals from microphone element 74 and converts the signal to digital information which is then stored in a digital storage media 80, such as a random access memory (RAM).

Upon activation, microcontroller 78 accesses the digital storage media 80 to retrieve the digital information contained therein, and converts the digital information to analog information which is then output to speaker element 76 for human perception. Alternatively, digital storage media 80 may be pre-programmed with a particular message, such as "GOOD JOB", or "CONGRATULATIONS", or "DON'T FORGET TO WASH YOUR HANDS!"

Electronic sound module 60 may be activated to record a message by pressing a "record" button 82 located on back surface 54 of body 51. Electronic sound module 60 may be activated to replay a message by any motion of body 51 as determined by a motion sensor 84, such as a mercury switch or hall effect sensor as is well known in the art. Such a sensor 84 will detect movement of body 51, such as when the toilet flushing handle accessory 50 is grasped and rotated during the activation of flushing handle 16.

Figure 8:
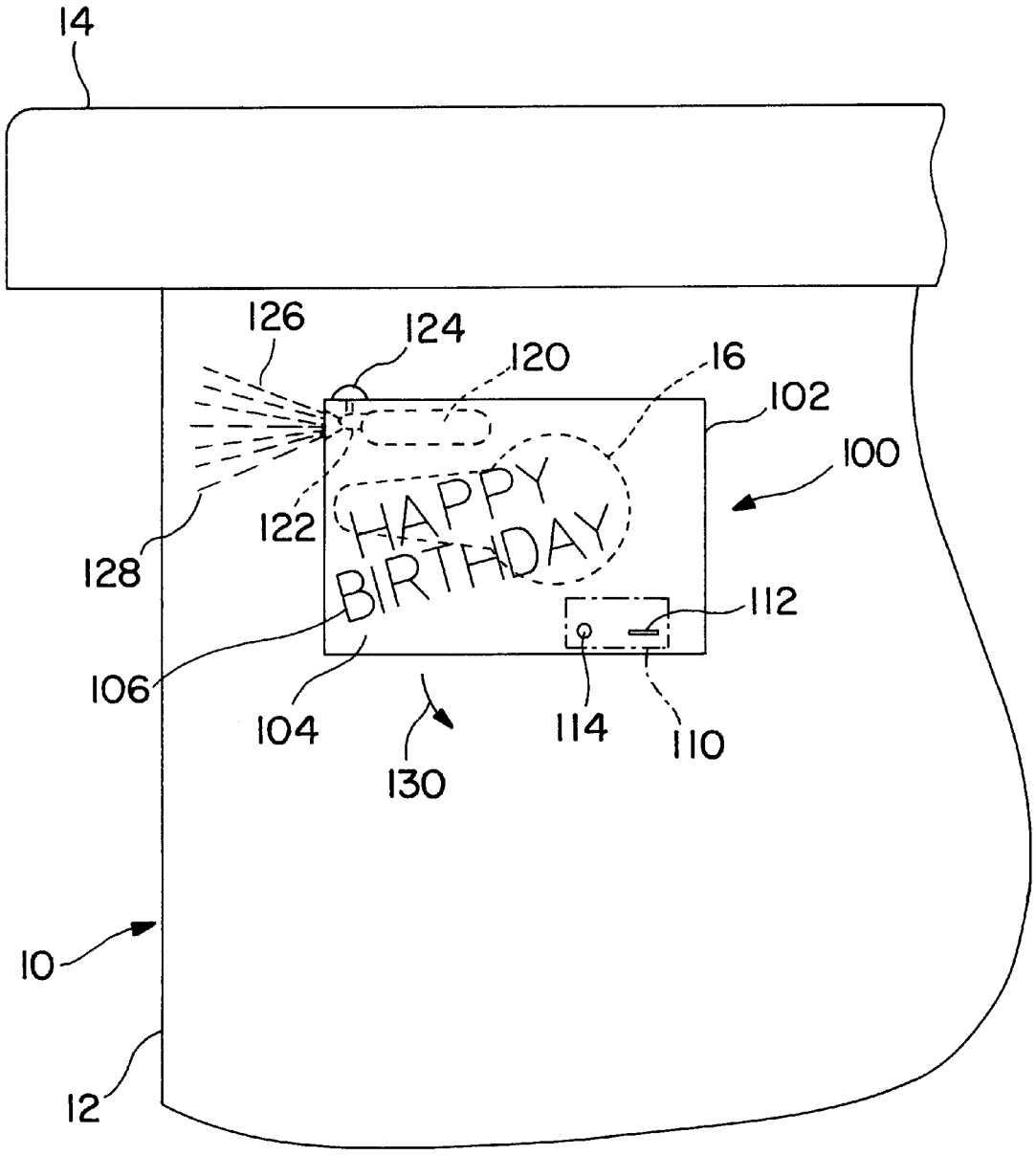
FIG. 8 is a front view of an alternative embodiment of the toilet flushing handle accessory of the present invention formed to have a rectangular body displaying a message, and having a scented spray dispenser (shown in dashed lines) and an electronic recording and playback device (also shown in dashed lines).

Referring now to FIG. 8, yet another alternative embodiment of the toilet flushing handle accessory of the present invention is shown and generally designated 100. Toilet flushing handle accessory 100 includes a body 102 having a front surface 104 which may include message 106, such as "HAPPY BIRTHDAY."

An electronic sound module 110 may be included in body 102, and body 102 can be formed with microphone aperture 112 and speaker aperture 114. As with electronic sound module 60 discussed above, electronic sound module 110 may record and playback audio messages.

Toilet flushing handle accessory 100 may also be equipped with a pressurized scented spray canister 120 having a chamber filled with a scented spray, and which includes a valve 122 leading to a nozzle 126. Valve 122 is controlled by activation button 124 such that when button 124 is pressed, a scented spray passes from pressurized canister 120 through valve 122 and out nozzle 126 in the form of spray 128.

The location of activation button 124 provides for the easy activation of valve 122 during the flushing of toilet 10. More particularly, when toilet flushing handle accessory 100 is attached to flushing handle 16, the toilet is flushed by pressing button 124 thereby rotating toilet flushing handle accessory 100 in direction 130. This rotation activates the internal flushing mechanism of toilet 10, while simultaneously activating valve 122 and providing the necessary motion to activate electronic sound module 110.

The embodiments of the toilet flushing handle accessory discussed above are merely exemplary of preferred embodiments of the present invention. The construction of the toilet flushing handle accessories outlined above may include a toilet flushing handle accessory which is constructed of plastic or ceramic, and includes a body which may contain rubber fasteners (O-rings), which grip around the outside of the toilet flushing handle. It should be appreciated, however, the materials used to construct or manufacture the present invention could include other materials known in the art, including a cloth material to create a "plush toy" version of the present invention.

Certain preferred embodiments have been described above. It is to be understood that a latitude of modification and substitution is intended in the foregoing disclosure, and that these modification s and substitutions are within the literal scope—or are equivalent to—the claims that follow.

While the toilet flushing handle accessory of the present invention as herein shown and disclosed in detail is fully capable of obtaining the objects and providing the advantages herein before stated, it is to be understood that it is merely illustrative of preferred embodiments of the invention and that no limitations are intended to the details of construction or design herein shown other than as described in the appended claims.

We claim:

1. A toilet Flushing handle accessory comprising:

a body having a front surface and a back surface;

an attachment means on said back surface for attaching said body to a toilet flushing handle;

an electronic sound module;

a scent producing module; and a activation means for activating said electronic sound module and said scent producing module.

* * * * *